United States Patent [19]

Meshbesher

[11] Patent Number: 4,648,948

[45] Date of Patent: Mar. 10, 1987

[54] ELECTROGENERATIVE OXIDATION OF LOWER ALCOHOLS TO USEFUL PRODUCTS

[76] Inventor: Thomas M. Meshbesher, 4507 Weldin Rd., Wilmington, Del. 19803

[21] Appl. No.: 858,342

[22] Filed: May 1, 1986

Related U.S. Application Data

[63] Continuation-in-part of Ser. No. 737,158, May 23, 1985, abandoned.

[51] Int. Cl.[4] ..... C25F 3/02

[52] U.S. Cl. ..... 204/79; 204/DIG. 4; 429/19; 429/27

[58] Field of Search ..... 429/19, 27; 204/74, 204/DIG. 4

[56] References Cited

U.S. PATENT DOCUMENTS 4,569,890 2/1986 Barthel ..... 429/19

*Primary Examiner*—R. L. Andrews

[57] ABSTRACT

In the disclosed electrogenerative process for converting alcohols such as ethanol to aldehydes such as acetaldehyde, the alcohol starting material is an aqueous solution containing more than the azeotropic amount of water. Good first-pass conversions (<40% and more typically <50%) are obtained at operating cell voltages in the range of about 80 to about 350 millivolts at ordinary temperatures and pressures by using very high flow rates of alcohol to the exposed anode surface (i.e. the "gas" side of an anode whose other surface is in contact with the electrolyte). High molar flow rates of vaporized aqueous alcohol also help to keep formation of undesired byproducts at a low level.

8 Claims, No Drawings

ELECTROGENERATIVE OXIDATION OF LOWER ALCOHOLS TO USEFUL PRODUCTS

The invention described herein was made in the course of work under a grant or award from the Department of Energy.

This is a continuation-in-part of my copending application, Ser. No. 737,158, filed May 23, 1985, now abandoned.

TECHNICAL FIELD

This invention relates to electrogenerative syntheses, i.e. syntheses in which fuel cell technology is used to make useful products from a substrate, the electricity produced thereby being only a "byproduct" of relatively minor importance. An aspect of this invention relates to the oxidation of lower (e.g. $C_1$–$C_5$) aliphatic alcohols to aldehydes and the like.

DESCRIPTION OF THE PRIOR ART

It is well known that primary alcohols can be oxidized or dehydrogenated to aldehydes. Both chemical and electrochemical processes have been used for this purpose. For example, methanol and ethanol have been oxidized in the presence of a silver catalyst at temperatures above 200° C. to obtain first-pass conversions of 25 mole-% or more to formaldehyde and acetaldehyde, respectively, with minor amounts of byproducts being formed (esters, carboxylic acids, etc.). A copper-containing catalyst has been used for dehydrogenation of lower primary alkanols such as ethanol. First-pass conversions tend to be better in such dehydrogenations, as compared to the oxidations described above; see U.S. Pat. No. 2,861,106 (Opitz et al), issued Nov. 18, 1958. Although these catalyzed chemical processes are thermodynamically favored, they are most effective with heated reactants and/or at temperatures above about 200° C.

Recently, it has been shown that ethanol can be electrogeneratively oxidized to acetaldehyde at ordinary temperatures (e.g. 15°–90° C.). See U.S. Pat. No. 4,347,109 (Aug. 31, 1982). When anhydrous (200 U.S. Proof) alcohol is used as the starting material, the first-pass yield (obtained by dividing the flow of $CH_3CHO$ in moles/min in the anode effluent by the molar flow of ethanol to the anode) is typically in the range of 15 to 40 mole-%. Short-circuiting the cell seems to improve the yield; however, acetal is formed as a byproduct, and molar yield of this byproduct appears to increase also as the cell voltage ($E_{cell}$) decreases. Throughout much or all of the operating ranges of the cell, the acetaldehyde:acetal ratio appears to be no better than about 11:1 and can be as low as 8:1. See Example 2 of the U.S. Pat. No. 4,347,109 patent. Nevertheless, the disclosure of the U.S. Pat. No. 4,347,109 patent sets forth a number of reasons why primary alcohols such as ethanol should still be considered to be viable alternatives to olefins as starting materials for the synthesis of aldehydes, and why fermentation alcohol is an attractive candidate for such snytheses in general and electrogenerative syntheses in particular. (Olefin oxidation has more or less displaced alcohol oxidation as the commercial route to some aldehydes, particularly acetaldehyde.)

In the classical ethanol-to-acetaldehyde processes, first-pass yields vary depending on the reaction conditions used, one of these conditions typically being an upper limit on the amount of water vapor present in the reaction zone. This upper limit may be as low as 6% by weight; see, for example, U.S. Pat. No. 1,977,750 (Young), issued Oct. 23, 1934. Sometimes water vapor is avoided altogether. See U.S. Pat. No. 4,383,124, issued May 10, 1983. By selecting certain molybdenum-containing catalysts, up to about 10% water can be tolerated in a chemical oxidation process conducted at 200°–400° C. See U.S. Pat. No. 4,471,141 (Windawi et al), issued Sept. 11, 1984. In the electrogenerative oxidation of ethanol, on the other hand, the upper limit on water vapor content in the anode feed is not so clearly defined. Opportunities exist for using rather dilute aqueous alcohol starting materials, if the problems connected with such use can be solved.

The problems seem to be formidable, at least at first blush. The $CH_3CHO$ yield in the anode effluent may suffer greatly, sometimes dropping to less than 10% of theory. Highly oxidized products (including $CO_2$) can form in large quantities. Products may dissolve in the electrolyte instead of staying in the anode effluent. It may be difficult to hold the yields to a consistent, predictable level.

Experience with an anhydrous ethanol feed in an electrogenerative, aldehyde-producing system provides no clear guidelines for the very same system using an aqueous solution of alcohol as the substrate or feed material. These alcohol-based electrogenerative systems have not been adequately studied and discussed in the literature, and there are no easy explanations for the sharp differences in behavoir as between the aqueous and anhydrous substrates. It is likely that the presence of water is not needed to bring about the conversion of alcohol molecules adsorbed on an electrocatalytic surfaces, yet, when water molecules do occupy some of the electrocatalytic sites, certain crucial parameters seem to be altered significantly. As correctly pointed out in the U.S. Pat. No. 4,347,109 patent, however, water is in no sense a catalyst poison.

SUMMARY OF THE INVENTION

Although the effect of water molecules on the electrogenerative alcohol-to-aldehyde system is still something of a mystery, the conditions for equalling or even excelling the performance of the anhydrous-feed systems have now been discovered. One or more of the following factors have been found to contribute to good selectivity and high yields in the electrogenerative oxidation of vaporized aqueous solutions of alcohols such as ethanol: high molar flow rates of alcohol to the anode, cell voltages above about 80 mv but preferably below about 350 mv (in any case while drawing usable current densities, e.g. above 5 ma/cm$^2$), and temperatures below 80° C., at atmospheric pressure and preferably below about 35° C. (particularly if alcohol feed rates are moderate rather than very high).

Accordingly, this invention contemplates an electrogenerative process for making lower aliphatic aldehydes from lower aliphatic primary alcohols, wherein (a) an aqueous solution of the lower aliphatic alcohol is vaporized and brought into contact with a first surface of an anode of a fuel cell, said fuel cell including an electrolyte within the cell, an anode having a second surface in contact with the electrolyte, a cathode, and external circuit means electrically connecting the cathod to the anode, exterior to the fuel cell, and an oxidant is brought into contact with the cathode; (b) the vaporized aqueous alcohol in contact with said first surface of the anode is treated anodically by electrogeneratively oxidizing the alcohol to the corresponding aldehyde at said first surface, thereby producing a flow of current in the external circuit means; (c) removing an aldehyde-containing effluent product stream from said first surface of the anode; and (d) recovering the aldehyde from said effluent stream; characterized in that:

(1) the first-pass conversion of alcohol to the corresponding aldehyde is more than 30 mole-%;

(2) the current density produced at the anode is more than 5 ma/cm$^2$;

(3) the operating cell voltage is in the range of about 80 to about 350 millivolts at a cell temperature of 15°-80° C.;

(4) if any acetal is produced at the anode, the aldehyde:acetal ratio in the effluent product steam is greater than 12:1; and (5) the molar flow rate of alcohol to each exposed cm$^2$ of said first surface of the anode is greater than $2\times10^{-6}$ mole/min.

The catalyst used according to the Examples of the U.S. Pat. No. 4,347,109 patent contains 25 mg of platinum black per cm$^2$ of electrode surface. This provides excellent electrocatalytic action, but is economically burdensome due to the high cost of platinum. It has now been found that good results can be obtained with electrodes containing $<10$ mg of platinum per cm$^2$. (Other noble metals of Group VIII of the periodic table can be substituted, if desired, and Group I-B metals have been successfully used in electrocatalysts.) For good results with $<10$ mg Group VIII metal per cm$^2$ of electrode surface, it is particularly important to maximize flow rates of alcohol and use mildly elevated temperatures ($>25°$ C., e.g. $>30°$ C.). Surprisingly good selectivity (e.g. low $CO_2$ production) can be obtained under these conditions. For commercial use, platinized carbon electrodes can lower the noble metal requirements to as low as about 0.5 mg/cm$^2$. Accordingly, it is presently believed to be essential, under these conditions, that the molar flow rate of alcohol to each exposed cm$^2$ of the anode be $>2\times10^{-5}$ mole/min., e.g. at least about $2.5\times10^{-5}$ mole/min., bearing in mind that the exposed anode surface contains less than 10 mg/cm$^2$ of electrocatalytic metal or metal oxide, the metallic form of the catalyst being preferred to the oxide form.

Since large amounts of electric power are consumed in the typical commercial fermentation methods for making ethanol (e.g. power for pumps, etc.), it is desirable that electric power be recovered from the cell. In the process of this invention, it appears that at least about 300 watt-hours of power can be recovered for each kilogram of acetaldehyde produced—without adverse effect upon aldehyde yield. (The theoretical maximum is about 1300 watt-hours/kg $CH_3CHO$.)

It is preferred that the first-pass conversion of alcohol to aldehyde be on the order of 40% of theory or more. Overall yields should be $>88\%$ (alcohol) and $>20\%$ (electricity).

DETAILED DESCRIPTION

The process of this invention is preferably operated in a continuous fashion, and first-pass yields of the aldehyde can be determined on a continuous basis by comparing the molar feed rate of alcohol to the molar flow rate of aldehyde in the anode effluent (product) stream. When a first-pass yield of aldehyde above 50 mole % is desired, it appears to be particularly desirable to use an alcohol molar feed rate of at least $2\times10^{-5}$ mole/min per square centimeter of anode surface exposed to the gaseous feed stream, i.e. about 0.2 mole/min per square meter of anode.

After the anode effluent has passed from the electrogenerative reactor into a recovery zone, both the aldehyde product and a portion of the water vapor in the effluent can be removed, so that the effluent stream becomes similar or identical in composition to the original alcohol feed and can be recycled to the anode along with fresh feed material. Such recycling, which permits a plurality of passes over the electrocatalyst in a single cell, can bring the effective overall aldehyde yield up to more than 90% of theory, e.g. 93% or more.

Current densities of about 15 to 60 ma/cm$^2$ can be obtained in practice, if desired. The preferred alcohol is ethanol, and the preferred product is acetaldehyde. The starting material is an aqueous solution of the alcohol. It is somewhat difficult to arrive at an optimum concentration for the alcohol solution. Considerations based solely upon economics may conflict with purely techincal considerations. Economic considerations may, for example, lead one to select an azeotropic ethanol/water mixture (which is about 95.6% by weight ethanol and boils at a constant temperature of 78.2° C. at 1.0 atm. pressure), while technical considerations may favor 20–90% by volume of ethanol (40–180 U.S. Proof), more preferably 50–180 or even 50–170 U.S. Pf (25–85 vol.-%), whereby acetal formation is supressed to less than 1 mole % and the $E_{cell}$ can be above 100 mv. Optimization involves taking all these considerations into account, hence concentrations above 50 vol.-% (100 U.S. Pf) but below 95 vol.-% (190 U.S. Pf) are preferred.

Suppression of acetal formation appears to be complete or almost complete when lower concentrations of alcohol are used. Surprisingly, improved yields of aldehyde can be obtained with aqueous alcohol starting materials (as compared to anhydrous materials), provided the conditions of this invention are provided. As for suppressing higher oxidation products (including $CO_2$), the $E_{cell}$, temperature, and especially the molar flow rates used in this invention appear to be very significant.

The preferred methods for vaporizing the aqueous alcohol starting material include heating (or distillation) and passing a heated or unheated current of inert gas ($N_2$, $CO_2$, He, etc.) through the aqueous alcohol starting material. In the case of relatively dilute aqueous methanol, ethanol, or propanol starting materials, virtually any vaporization technique will tend to decrease the concentration of water in the feed stream, due to the lower vapor pressure of water as compared to the alcohol.

At flow rates above $2\times10^{-6}$ mole/min per cm$^2$ exposed anode surface, or, better still, at rates above $4\times10^{-6}$ mole/min, preferably above $5\times10^{-6}$ mole/min per cm$^2$, many of the problems of the electrogenerative conversion of aqueous alcohol vapor to aldehydes such as acetaldehyde can be alleviated. (All molar flow rates are corrected to a 100% alcohol basis, and since experiments are done with approximately 5.1 cm$^2$ of anode surface exposed to the alcohol, raw data are: above $1\times10^{-5}$, above $2\times10^{-5}$, and above $2.5\times10^{-5}$ mole/min, etc.) At flow rates below $2\times10^{-6}$ mole/min per cm$^2$ anode, loss of acetaldehyde yield can be drastic.

According to the practice of this invention, however, acetaldehyde yields above 40 or 50% on the first pass are consistently achieved, and first-pass yields above 60% are obtainable, with suppression of the formation of undesired byproducts. Moreover, the higher the flow rate, the less limiting the temperature factor appears to be (and perhaps also the $E_{cell}$ factor). That is, it is much safer to use higher temperatures (35°-80° C.) at higher flow rates.

The variables described above therefore appear to be optimized as follows, bearing in mind that the starting material is aqueous ethanol (e.g. 25-95% by volume) and the current density at the stated voltage is above 10 ma/cm$^2$, the experimental cell having about 5.1 cm$^2$ of anode surface exposed to the feed stream (i.e. the vaporized starting material).

| Voltage, mv ($E_{cell}$) | Temperature (°C.) | Molar Flow Rate of Ethanol (mole/min per cm$^2$ anode surface) |
|---|---|---|
| 100-350 | 20-80 | above $1 \times 10^{-4}$ |
| 100-325 | 20-35 | 5 to $100 \times 10^{-6}$ |
| 90-275 | 20-35 | 3.7 to $5 \times 10^{-6}$ |
| 125-250 | 20-25 | $>2$ but $<3.7 \times 10^{-6}$ |

If any acetal is produced under these conditions, the aldehyde:acetal ratio is well above 12:1, e.g. 40:1 or more.

Modifications of the process described above are, of course, to be considered in industrial practice. Various improved cell designs are among such modifications (e.g. non-aqueous electrolytes, including solid electrolytes with attached electrodes, see Katayama-Aramata et al, *JACS* 105:658 [1983], supported metal catalysts or anchoring redox catalysts on electrode surfaces, etc.) This invention is illustrated by the following non-limiting Examples, and the significance of certain parameters is shown by the Comparative Examples.

The cell assembly used is the same as that described in Example 1 of U.S. Pat. No. 4,347,109, and the alcohol oxidation runs were carried out generally as in Example 2 of that patent. Analyses of feed and product streams were also carried out as in the U.S. Pat. No. 4,347,109 patent, and product $CO_2$, where reported, was measured by sampling the product anode stream and analyzing with a Porapak Q column at 45°. Ambient and cell temperatures both were in the range of 23°-24° C., unless otherwise indicated. Reported cell potentials are IR-corrected using cell resistance value measured under hydrogen at both electrodes prior to the polarization runs. The amount of anode surface on the gas side (exposed to the anode feed stream) was almost exactly 5.1 cm$^2$.

COMPARATIVE EXAMPLE 1

Anhydrous Ethanol (200Pf)

A saturator containing 100% (200 U.S. Pf) ethanol was set up as in U.S. Pat. No. 4,347,109, Examples 1 and 2. The carrier gas was nitrogen. The gas flow rate from the saturator (feed flow rate, F) was 30 cm$^3$/min. The molar flow rate of ethanol to the gas side of the anode ($N_E$) was found to be $5.59 \times 10^{-5}$ mole/min. $= 1.10 \times 10^{-5}$ mole/min. per cm$^2$ of exposed anode surface on the gas side. The LAA-25 Pt-black electrode (American Cyanamid; see U.S. Pat. No. 3,407,096 to Landi of October, 1968) provided 25 mg Pt/cm$^2$.

Resistance (R) was measured and found to be 0.36 ohm. From about 16 to 44 ma/cm$^2$ current (I) was drawn from the cell, depending on the voltage (E). Acetaldehyde yield ($Y_A$), determined as the ratio of acetaldehyde flow in the anode effluent to ethanol flow to the anode was observed to increase with decreasing voltage and increasing current density.

The results are set forth in Table I.

TABLE I

| E (mv) | I (ma/cm$^2$) | $N_A$ ($10^{-5}$ mol/min) | $Y_A$ (%) | $A_A$ (%) |
|---|---|---|---|---|
| 309 | 16.2 | 0.79 | 14 | 32.3 |
| 201 | 34.0 | 1.85 | 33 | 35.0 |
| 141 | 44.0 | 2.21 | 40 | 31.5 |

$N_A$ = molar flow rate of acetaldehyde measured in anode effluent
$Y_A$ = conversion to acetaldehyde in product stream relative to ethanol feed
$A_A$ = current accountability value, i.e. % of generated current accounted for by acetaldehyde production.

COMPARATIVE EXAMPLE 2

Using 25 vol.-% Aqueous Alcohol

The purpose of this Example was to demonstrate the effect of a slow molar feed rate (low $N_E$). The saturator was filled with 25 volume-% ethanol/75 volume-% water. The molar flow rate $N_E$ was kept at only $0.564 \times 10^{-5}$ mole/min or about $0.11 \times 10^{-5}$ (i.e. $1.1 \times 10^{31\ 6}$) mole/min per cm$^2$ exposed anode surface (gas side). Feed flow rate (F) was 12 cm$^3$/min. Resistance (R) was 0.31 ohm. Otherwise, conditions were as in Comparative Example 1. Surprisingly, $Y_A$ decreased with decreasing voltage. See Table II, below. It was also considered surprising that the slow flow rate detracted from, rather than enhanced, ethanol conversion.

TABLE II

| E (mv) | I (ma/cm$^2$) | $N_A$ ($10^{-5}$ mol/min) | $Y_A$ (%) | $A_A$ (%) |
|---|---|---|---|---|
| 296 | 14.6 | 0.162 | 29 | 7.1 |
| 180 | 16.4 | 0.134 | 24 | 5.2 |
| 44 | 19.6 | 0.014 | 2.5 | $<1.0$ |

E, I, $N_A$, $Y_A$ and $A_A$ are defined above; see Comparative Example 1.

EXAMPLE 1

25 vol.-% Aqueous Ethanol; 25 and 9 mg/cm$^2$ of Pt

Comparative Example 2 was repeated, except that $CO_2$ production was monitored, flow rates were varied, and catalytic site density was varied. Byproduct acetal production in these runs was found to be $<0.1\%$. With the LAA-25 (25 mg Pt/cm$^2$) electrodes, optimum results were obtained at gas flow rates (F) of 60 cm$^3$/min or more. Molar flow rate of ethanol was 2.88 to $3.06 \times 10^{-5}$ mole/min., using a 5 cm$^2$ anode, so that the flow to each cm$^2$ of exposed anode surface was at or near $0.6 \times 10^{-5}$ mole/min. R was 0.36 ohm. E ranges from 319 to 116 mv; I ranged from 23 to 45.8 ma/cm$^2$. The best yield of aldehyde ($Y_A$) was at 231 mv and was 67 mole-%. Carbon dioxide production was about 2.7 mole-%. Current accountability ($A_A$) was 32.9% ($CH_3CHO$) and 8% ($CO_2$). When using an American Cyanamid LAA-2 anode (9 mg Pt/cm$^2$), results were, at first, less attractive, but see the subsequent Examples. Moreover, good results could be obtained even with 25 vol.-% ethanol and the LAA-2 electrode by raising the saturator temperature to 36° C. and the cell temperature to 37° to 38° C. At an $N_E$ value of $8.7 \times 10^{-5}$ mole/min. (5 cm$^2$ anode) and an F of 59 cm$^3$/min., E=330 mv provided a surprising 39 ma/cm$^2$ of current density. Aldehyde yield was only 16%, but $A_A$ was 23%. The $CO_2$ yield was 9% (36% current accountability).

EXAMPLE 2

≧50 Vol.-% Aqueous Ethanol; 9 mg/cm$^2$ of Pt

The high $CO_2$ production problem observed with the LAA-2 anode seemed to be solved, even without higher Pt loadings, by utilizing 50–75 vol.-% ethanol, a cell temperature of 38° C., and a heated saturator (36° C.), particularly when F was stepped up to 64 cm$^3$/min. Even at 59 cm$^3$/min total gas flow, observed $CO_2$ production dropped to an amazingly low 0–1 mole-%. The $N_E$ values in this series of experiments were $12\times10^{-5}$ mole/min. (without heated saturator) or, more preferably, $14\times10^{-5}$ mole/min. (with heated saturator at 36° C.). Representative results were, at F=64 cm$^3$/min, R=0.25 ohm, $N_E=14\times10^{-5}$ mole/min., 50 vol.-% aq. ethanol in the heated saturator E: 167 mv
I: 63 ma/cm$^2$
$N_A$: $5.9\times10^{-5}$mole/min.
$Y_A$: 43% (1% $CO_2$)
$A_A$: 59% (9% $CO_2$)

and, at F=59 cm$^3$/min., R=0.22 ohm, with 75 vol.-% ethanol in the heated saturator (all temperatures, flow rates, etc. otherwise the same as for the 50 vol.-% run)

E: 143 mv.
I: 61 ma/cm$^2$
$N_A$: $5.9\times10^{-5}$mole/min.
$Y_A$: 41% (;b 1% $CO_2$)
$A_A$: 61% (12% $CO_2$).

When organic polymeric fibers are carbonized and then platinized, the resulting electrocatalytic material, through low in actual Pt content (typically <3 mg/cm$^2$, and usually 0.5–1 mg/cm$^2$) provides the equivalent of a very high loading of platinum metal. When using a highly active material of this type, still better results are to be expected, including better yields of acetaldehyde and better $A_A$ values.

What is claimed is:

1. The process for making lower aliphatic aldehydes from lower aliphatic primary alcohols, wherein (a) an aqueous solution of the lower aliphatic alcohol is vaporized and brought into contact with a first surface of an anode of a fuel cell, said fuel cell including an electrolyte within the cell, an anode having a second surface in contact with the electrolyte, a cathode, and external circuit means electrically connecting the cathode to the anode, exterior to the fuel cell, and an oxidant is brought into contact with the cathode; (b) the vaporized aqueous alcohol in contact with said first surface of the anode is treated anodically by electrogeneratively oxidizing the alcohol to the corresponding aldehyde at said first surface, thereby producing a flow of current in the external circuit means; (c) removing an aldehyde-containing effluent product stream from said first surface of the anode; and (d) recovering the aldehyde from said effluent stream; characterized in that:

(1) the first-pass conversion of alcohol to the corresponding aldehyde is more than 30 mole-%;
(2) the current density produced at the anode is more than 5 ma/cm$^2$;
(3) the operating cell voltage is in the range of about 80 to about 350 millivolts at a cell temperature of 15°–80° C.;
(4) if any acetal is produced at the anode, the aldehyde:acetal ratio in the effluent product steam is greater than 12:1; and
(5) the molar flow rate of alcohol to each exposed cm$^2$ of said first surface of the anode is greater than $2\times10^{-6}$ mole/min.

2. The process according to claim 1, wherein the lower aliphatic primary alcohol is ethanol and the aldehyde product is acetaldehyde.

3. The process according to claim 2, wherein the ethanol starting material is an aqueous solution containing at least the azeotropic amount of water but not more than 80% by volume of water.

4. The process according to claim 2 wherein the ethanol starting material is vaporized by passing a current of inert gas through an aqueous solution of the ethanol.

5. The process according to claim 2, said process being operated continuously, wherein:

(1) the first-pass conversion of alcohol is at least about 50 mole %;
(2) the current density produced at the anode is greater than 10 ma/cm$^2$;
(3) the operating cell voltage is in the range of about 100 to 350 millivolts;
(4) the amount of acetal formed at and flowing from the anode, if any, is less than about 1 mole %, by reference to the flow rate of ethanol to the said first surface of the anode; and
(5) the molar flow rate of ethanol to each exposed square centimeter of said first surface of the anode is at least $2\times10^{-5}$ mole/min.

6. The process according to claim 5 wherein the yield of acetaldehyde, based on the amount of said molar flow rate of ethanol, is brought up to more than 90% of theory by recycling of the effluent stream after the acetaldehyde and a portion of the water vapor have been removed therefrom.

7. The process according to claim 1, wherein the anode of the fuel cell provides less than 10 mg of electrocatalytic metal or metal oxide per square centimeter of anode surface.

8. The process according to claim 7, wherein the first-pass conversion of alcohol is at least about 40 mole %.

* * * * *